US005094048A

United States Patent [19]

Woo

[11] Patent Number: 5,094,048

[45] Date of Patent: Mar. 10, 1992

[54] TRANSPORTABLE MODULAR HOME

[76] Inventor: Chi G. Woo, 2119 Potspring Rd., Lutherville, Md. 21093

[21] Appl. No.: 627,483

[22] Filed: Dec. 14, 1990

[51] Int. Cl.[5] ..... E04H 1/12

[52] U.S. Cl. ..... 52/143; 52/65; 52/31; 248/352; 248/188.4

[58] Field of Search ..... 52/143, 65, 31; 248/349, 352

[56] References Cited

U.S. PATENT DOCUMENTS

| | | | |
|---|---|---|---|
| 1,140,176 | 5/1915 | Martzolf | 52/31 |
| 2,719,383 | 10/1955 | Emmert | 248/188.4 |
| 2,815,539 | 12/1957 | Schneider | 52/31 |
| 2,945,662 | 7/1960 | Jennings | 248/354.3 |
| 2,965,413 | 12/1960 | Barnes | 52/65 |
| 3,713,259 | 1/1973 | Tkach | 248/352 |
| 4,014,517 | 3/1977 | Keagle | 248/352 |
| 4,882,887 | 11/1989 | Giles et al. | 52/143 |

FOREIGN PATENT DOCUMENTS

| | | | |
|---|---|---|---|
| 2709706 | 9/1978 | Fed. Rep. of Germany | 52/143 |
| 1555830 | 1/1969 | France | 52/65 |
| WO84/00045 | 1/1984 | PCT Int'l Appl. | 52/143 |

*Primary Examiner*—Richard E. Chilcot, Jr.
*Assistant Examiner*—Joanne C. Downs
*Attorney, Agent, or Firm*—Birch, Stewart, Kolasch & Birch

[57] ABSTRACT

A transportable modular home includes at least four extensible supporting members correspondingly extending therefrom to the ground and a rotatable bearing member mounted to the bottom of the modular home for easily loading and aligning the modular home with a trailer so as to comply with the law and affix the modular home to the trailer for traveling on a public highway.

7 Claims, 2 Drawing Sheets

TRANSPORTABLE MODULAR HOME

BACKGROUND OF THE INVENTION

1. Field of the Invention

The present invention relates to a transportable modular home and more particularly, to a mobile and modular home including at least four extensible supporting members for raising the home and a rotatable bearing member for easily rotating the home on a trailer so as to easily ship the home on the trailer in order to comply with the law and affix the modular home to the trailer for traveling on a public highway or the like.

2. Description of the Prior Art

Various types of modular homes are well known in the art. Such modular homes include a jack assembly for manually lifting the homes as shown in U.S. Pat. Nos. 3,830,024, 3,884,494, and 4,320,607. However, such modular homes suffer from a number of disadvantages such as, for example, (a) it is very difficult to lift the modular homes by the manual jack assembly, (b) it is difficult to raise the supports of the modular homes corresponding to relative height of the ground, (c) it is very difficult for the modular homes to travel on the trailer so as to comply with the law and affix the modular home to the trailer, and (d) it is very high cost to load the modular homes to the trailer since a separate crane is needed to load or unload the modular homes onto the trailer or the ground.

SUMMARY OF THE INVENTION

Accordingly, it is an object of the present invention to provide an improved transportable modular home.

Another object of the present invention is to provide a modular home having at least four extensible supports capable of being individually raised and lowered to correspond to the different heights of the ground thus quickly establishing and maintaining stability of the modular home.

A further object of the present invention is to provide a transportable house including a rotatable bearing member mounted to the bottom thereof for an easy rotation of the modular home on a floor of the trailer so as to easily ship and align with the trailer in order to comply with the law and affix the modular home to the trailer for traveling on a public highway or the like.

Still another object of the present invention is to provide a portable, temporary housing which is simple in construction, inexpensive to manufacture, and easy in use.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a transportable modular home including at least four extensible supports correspondingly extending therefrom to the ground and a rotatable bearing member mounted to the bottom of the home for easily shipping and aligning the modular home with a trailer so as to comply with the law and affix the modular home to the trailer for traveling on a public highway.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 7 is a perspective view of the transportable modular home of the present invention showing the house structure in a loaded position on the floor of the trailer so as to comply with the law and affix the modular home to the trailer for traveling on a public highway or the like.

DESCRIPTION OF THE PREFERRED EMBODIMENTS

Figure 1:
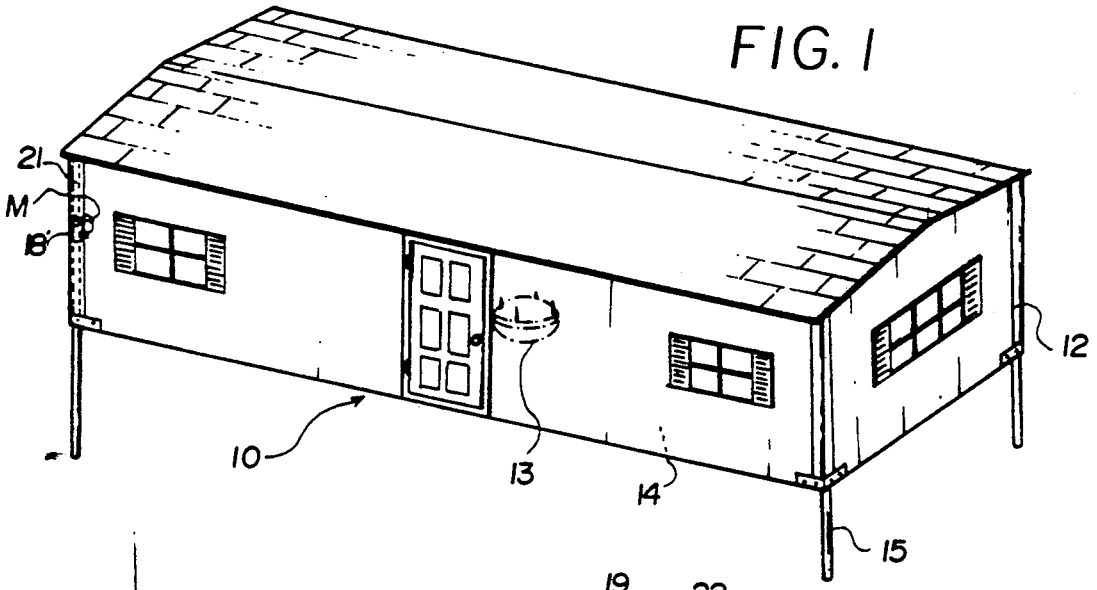
FIG. 1 is a perspective view of the transportable modular home of the present invention.
Figure 2:
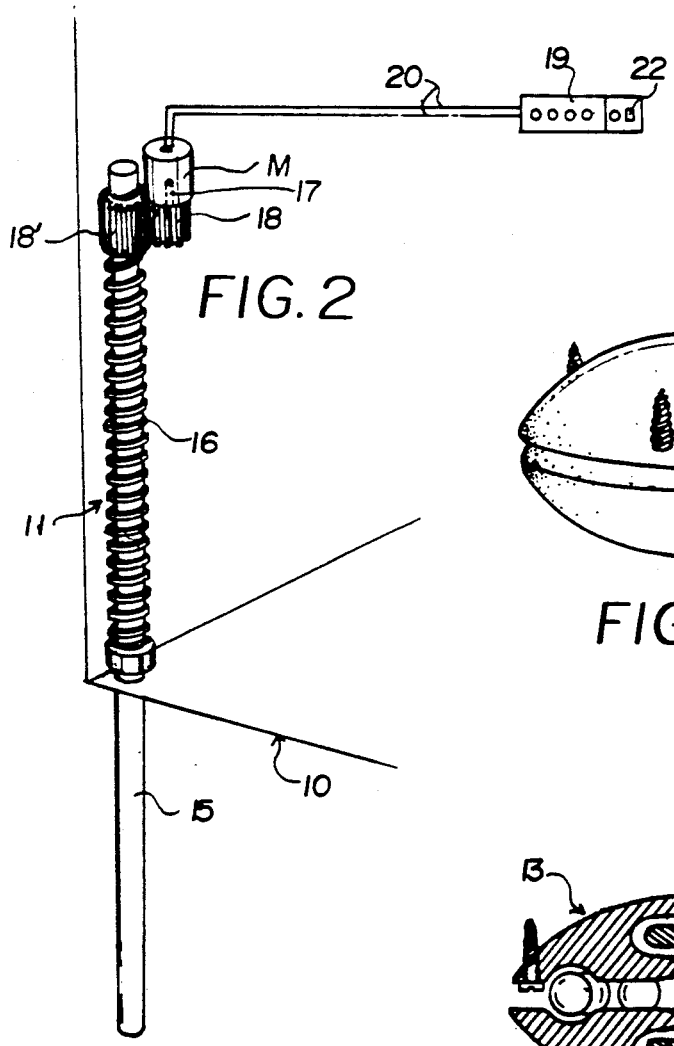
FIG. 2 is an enlarged perspective view of an extensible supporting member according to the present invention.
Figure 3:
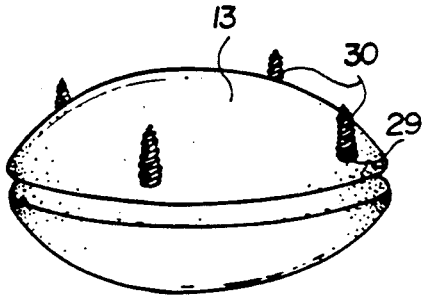
FIG. 3 is a perspective view of a rotatable bearing member of the modular home of the present invention.
Figure 4:
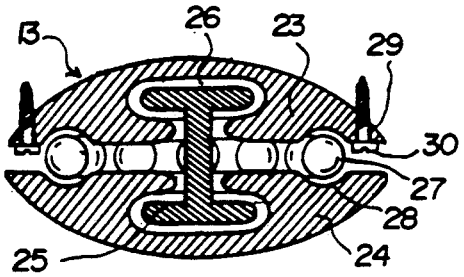
FIG. 4 is a sectional view of FIG. 3.

Referring now in detail to the drawings for the purpose of illustrating preferred embodiments of the present invention, the transportable modular home as shown in FIGS. 1, 2, and 3, comprises a modular house structure 10, at least four extensible supporting members 11 positioned at least four corners 12 of the modular house structure, and a rotatable bearing member 13 mounted to the bottom 14 of the modular house structure 10.

The extensible supporting member 11 includes an anchor rod 15 having an anchor screw 16 disposed the upper portion thereof, a two-way motor M having a shaft 17 and a co-axial gear 18 for being in gearing relationship with a cylindrical gear 18' which has a cylindrical inner screw (not shown) in screwing relationship with the anchor screw 16. Therefore, when the motor M is actuated by a switch 19 with an electric wire 20, the co-axial gear 18 raises the anchor screw 16 into a vertically elongated hole 21 of the corner 12 or lowers the same according to a relative height of the ground on which the modular house structure is to be built. At this time, an oil pressure piston system can replace the power screw system as described above. If necessary, one or two extensible supporting members 11 can be positioned in the middle portion of the house structure 10. Also, the switch 19 can contain a main switch 22 for uniformly lifting and lowering all the anchor rods 15 at the same time. When the modular home structure 10 is transported, the extensible supporting members 11 are raised up and laid in the vertically elongated holes 21 of the corners 12 so that the anchor rods 15 are hidden in the modular house structure 10.

Figure 5:
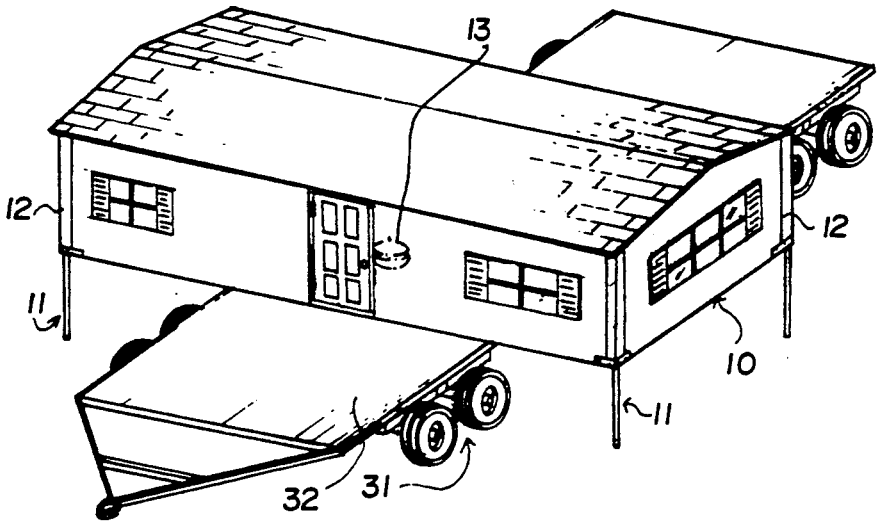
FIG. 5 is a perspective view of the transporting modular home of the present invention showing the trailer positioned underneath the modular home and the extensible supporting members lowered from the home structure.
Figure 6:
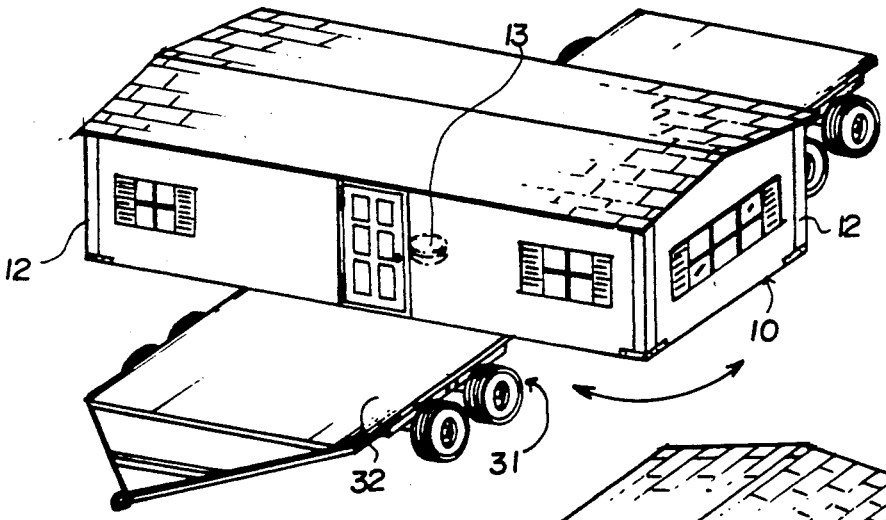
FIG. 6 is a perspective view of the transporting modular home of the present invention showing the raised supporting members hidden in the modular home and the rotatable bearing member mounted to the bottom of the house structure in connected with the floor of the trailer in order to rotate the house structure for aligning with the trailer.
Figure 7:
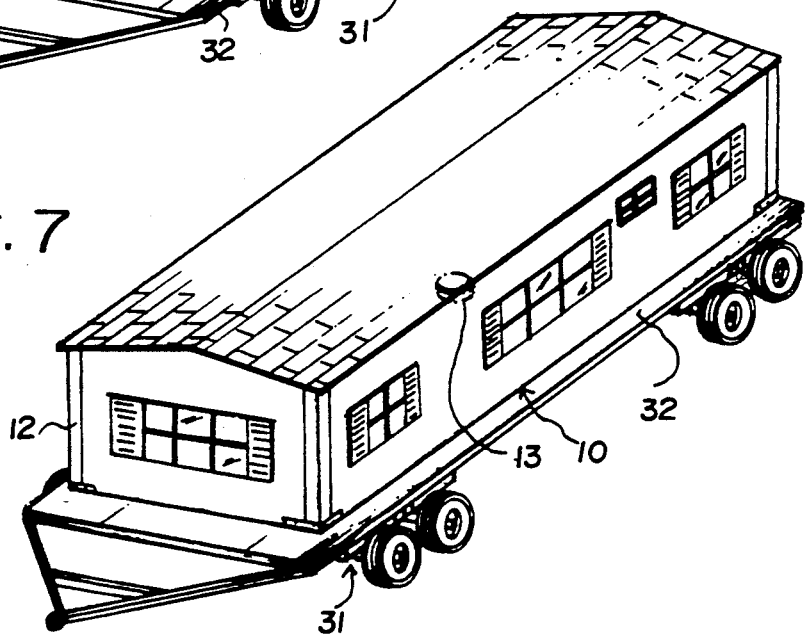

The rotatable bearing member 13 includes upper and lower circular plates 23 and 24 having a narrow neck groove 26, respectively, a H-shaped connecting support 25 rotatably inserted into the pair of narrow neck grooves 26 of the upper and lower circular plates 23 and 24, and a plurality of bearings 27 disposed in bearing slots 28 which are formed between the upper and lower circular plates 23 and 24. The upper circular plate 23 is provided with a plurality of apertures 29 for mounting the bearing member 13 to the bottom of the house structure 10 by a plurality of screws 30. Thus, the rotatable bearing member 13 fixed to the bottom of the house structure 10 is put on a floor 32 of the trailer 31 and smoothly rotated thereon so as to comply with the law and affix the modular home to the trailer for traveling on a public highway or the like (FIGS. 5, 6, and 7).

The transportable modular home of the present invention operates as follows. As shown in FIGS. 5, 6, and 7, first of all, in order to load the modular home on the floor 32 of the trailer 31, the trailer 31 is positioned underneath the house structure 10 and between the anchor rods 15. Second, by raising the plurality of anchor rods 15 using the switch 19 or the main switch 22, the rotatable bearing member 13 is tightly closed to the floor 32 of the trailer 31 (FIG. 5). Third, at this time, the house structure 10 is rotated clockwise or counterclockwise to align with the trailer 31 so as to comply with the law and affix to the trailer the modular home for traveling on a public highway or the like (FIGS. 6 and 7).

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A transportable modular home comprising:

a house structure having at least four corners each with a vertically elongated hole, respectively, at least four extensible supporting members vertically aligned with each of said respective vertically elongated holes, each extensible supporting member having an anchor rod with an anchor screw disposed on the upper portion thereof for inserting said anchor rod into each of said vertically elongated holes, respectively, and a rotatable bearing member mounted to the bottom of said house structure for smoothly rotating said house structure on a floor of a trailer positioned underneath said house structure, whereby the transportable modular home is firmly supported by the extensible supporting members capable of corresponding to different heights of the ground, and can facilitate the transportation of the modular home on the floor of the trailer in order to comply with the law and affix the modular home to the trailer for traveling on a public highway or the like.

2. The transportable modular home of claim 1, wherein the extensible supporting members are four.

3. The transportable modular home of claim 2, wherein the extensible supporting members are five.

4. The transportable modular home of claim 1, wherein each of the extensible supporting members further includes a two-way motor having a shaft, a co-axial gear for being in gearing relationship with a cylindrical gear which has a cylindrical screw in screwing relationship with said anchor screw of the anchor rod, and switch means for controlling the position of the anchor rod.

5. The transportable modular home of claim 4, wherein the switch means includes a main switch for uniformly raising and lowering the all anchor rods at the same time.

6. The transportable modular home of claim 1, wherein the rotatable bearing member includes upper and lower circular plates, an H-shaped support rotatably inserted into said upper and lower circular plates, and a plurality of bearings disposed in a plurality of bearing slots formed between said upper and lower circular plates for smoothly rotating the upper and lower circular plates with respect to each other without any direct contact between said circular plates.

7. The transportable modular home of claim 6, wherein the upper circular plate is provided with a plurality of apertures disposed therein for disposing the rotatable bearing member onto the bottom of the house structure.

* * * * *